US006513975B1

(12) United States Patent
Jackson et al.

(10) Patent No.: US 6,513,975 B1
(45) Date of Patent: Feb. 4, 2003

(54) BAG WITH EXTENSIBLE HANDLES

(75) Inventors: Beverly Ann Julian Jackson, Hamilton; Daniel Raymond Cerone, West Chester, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/597,182

(22) Filed: Jun. 19, 2000

(51) Int. Cl.[7] ..... B65D 30/02
(52) U.S. Cl. ..... 383/118; 383/62; 383/105
(58) Field of Search ..... 383/14, 62, 71, 383/77, 105, 118, 903

(56) References Cited

U.S. PATENT DOCUMENTS

| | | | | | |
|---|---|---|---|---|---|
| 1,962,071 | A | * | 6/1934 | Greene | 383/118 |
| 4,326,664 | A | * | 4/1982 | Benoit et al. | 383/903 X |
| 4,401,427 | A | * | 8/1983 | Benoit et al. | 383/903 X |
| 4,764,029 | A | * | 8/1988 | Abblett | 383/903 X |
| 4,778,283 | A | | 10/1988 | Osborn | |
| 5,205,650 | A | * | 4/1993 | Rasmussen | 383/903 X |
| 5,246,110 | A | | 9/1993 | Greyvenstein | |
| 5,518,801 | A | * | 5/1996 | Chappell et al. | 428/152 |
| 5,650,214 | A | * | 7/1997 | Anderson et al. | 383/118 X |
| 5,662,758 | A | * | 9/1997 | Hamilton et al. | 156/221 |
| 6,113,269 | A | * | 9/2000 | DeMatteis et al. | 383/118 X |
| 6,139,185 | A | * | 10/2000 | Hamilton et al. | 383/71 X |
| 6,149,304 | A | * | 11/2000 | Hamilton et al. | 383/62 |
| 6,150,647 | A | * | 11/2000 | Anderson et al. | 383/126 X |
| 2001/0022865 | A1 | | 9/2001 | Meyer et al. | |

FOREIGN PATENT DOCUMENTS

| | | |
|---|---|---|
| EP | 0 338 747 A1 | 10/1989 |
| WO | WO 00/78937 A1 | 12/2000 |

* cited by examiner

*Primary Examiner*—Jes F. Pascua
(74) *Attorney, Agent, or Firm*—David K. Mattheis; David M. Weirich; Larry L. Huston

(57) ABSTRACT

A bag made of flexible sheet material having an opening defined by a periphery. Juxtaposed with the periphery is a closure zone. The closure zone has induced extensibility in a direction perpendicular to the opening of the bag so that handle ties may be conveniently formed upon extension of the closure zone material. The handle ties are bound together to form an integral closure for the bag. The induced extensibility is provided by a network of dual regions having different modes of extensibility. The dual region network also provides the advantage of an increased gripping surface for forming the handle ties.

4 Claims, 4 Drawing Sheets

BAG WITH EXTENSIBLE HANDLES

FIELD OF INVENTION

The present invention relates to bags commonly used to contain and dispose of various items, and more particularly to bags having an integral closure system.

BACKGROUND OF THE INVENTION

Bags, particularly flexible bags, are often made of comparatively inexpensive polymeric materials. Such bags have been widely employed for containment and/or disposal of various items and/or materials. As utilized herein, the term "flexible" refers to materials which are capable of being flexed or bent, especially repeatedly, since they are compliant and yieldable in response to externally applied forces which ordinarily occur during the use of the bag. Accordingly, "flexible" is substantially opposite in meaning to the terms "inflexible", "rigid" or "unyielding" in response to external forces normally occurring in use. Materials and structures which are flexible, therefore, may be altered in shape and structure to accommodate external forces and to conform to the shape of objects brought into contact with them without losing their integrity. For example, flexible bags may be used as liners for durable trash cans.

For purposes of storing or disposing of materials contained in flexible bags, several techniques to close the bag are known in the art. For example, twist ties have been commonly utilized. However, twist ties require a component separate from the trash bag, i.e., the twist tie itself This separate component may become lost or accidentally discarded. Also, twist ties have not achieved great success in providing secure closure of bags.

Another technique known in the art is to use sinusoidally-shaped edges at the opening of the bag. These edges can be overlapped and tied together to form handles, as illustrated in U.S. Pat. No. 5,246,110, issued Sep. 21, 1993 to Greyvenstein. However, the sinusoidal edges which are to become the handles drape unevenly over the top of any durable container which the flexible bag may line. This provides an uneven and unsightly appearance while the flexible bag is in use. Furthermore, the stretch characteristics of the material forming the handle is typically equivalent to that forming the balance of the bag. This prevents the handles from preferentially straining during the tying procedure and providing a means of closing the bag which is easy to use.

A Yet another technique known in the art is to provide a drawstring at the top circumference of the bag as illustrated in U.S. Pat. No. 4,778,283, issued Oct. 18, 1988 to Osborn. However, the drawstring closure is expensive and often rips in use.

Commonly assigned U.S. application Ser. No. 09/336,211, filed Jun. 18, 1999 in the name of Jackson, and Ser. No. 09/336,212, filed Jun. 18, 1999 in the name of Meyer et al., the disclosures of which are incorporated herein by reference, disclose flexible bags having closures. Specifically, drawstring-type closures, tyable handles or flaps, twist-tie or interlocking strip closures, adhesive-based closures, interlocking mechanical seals, removable ties, or strips made of bag composition, and heat seals are disclosed.

The present invention provides a closure for a flexible bag which is easy to use, integral with the bag, and utilizes preferred material properties of the bag.

SUMMARY OF THE INVENTION

The present invention is a bag having at least one sheet of flexible material assembled to form a semi-enclosed container. The container has an opening defined by a periphery. The bag has a fill direction generally perpendicular to the opening. The bag has a closure zone juxtaposed with the periphery. The closure includes a first region and a second region. The first region undergoes a substantially molecular-level deformation and the second region initially undergoes a substantially geometric deformation when the sheet of flexible material is subjected to applied tensile forces. The closure zone of the bag is extensible in the fill direction in response to such tensile forces. The tensile forces may be applied generally parallel to the fill direction.

DETAILED DESCRIPTION OF THE INVENTION

Figure 1:
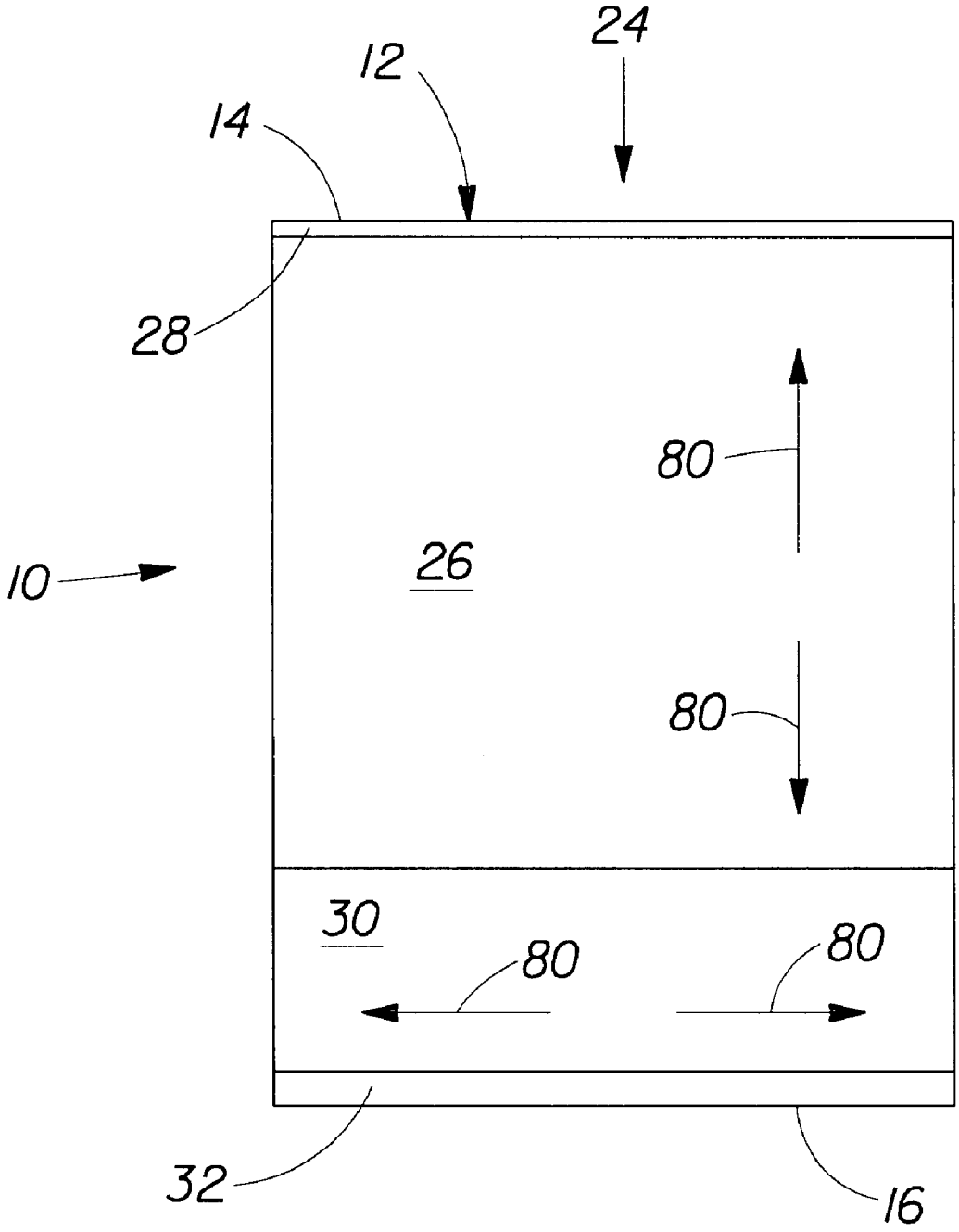
FIG. 1 is a plan view of a flexible bag in accordance with the present invention in a closed, empty condition.

FIG. 1 depicts one embodiment of a bag 10 according to the present invention. The bag 10 also has an opening 12 defined by a periphery 14. Opposite the opening 12 is the bottom 16 of the bag 10. Although a bag 10 having only one opening 12 is illustrated, it is contemplated that bags 10 having more than one opening 12 of like or unequal sizes may be encompassed within the scope of the present invention. Intermediate the opening 12 and bottom 16 of the bag 10 is the body of the bag 10.

Juxtaposed with the opening 12 are integral closures for closing the bag 10. The closures may fully seal the bag 10 to prevent loss of contents or simply loosely seal the bag 10 to minimize loss of contents from the bag 10 during ordinary use. As used herein, a closure is considered integral with the bag 10 if it is formed entirely from the parent material of the bag 10 and does not change in construction from the body of the bag 10. Accordingly, twist ties, drawstring closures, interlocking strip closures, and mechanical seals are not considered to be integral closures.

In the embodiment according to FIG. 1, the bag 10 is made of flexible material and includes a bag 10 body formed from a piece of flexible material folded upon itself along a fold line and bonded to itself along side seams. It is to be understood that the bag 10 could be folded along other fold lines and bonded along other seams as well. Alternatively, the bag 10 may have a unitary construction. The bag 10 can also be constructed from a continuous tube of sheet material 52, thereby eliminating the side seams and having a bottom 16 seam in place of the bottom 16 fold line.

It is contemplated that the bags 10 according to the present invention may be of various sizes depending upon the ultimate intended use. For example, the bags 10 according to the present invention may have a volume of only a few cubic centimeters and be usable for storing pills, coins, etc. Alternatively, the bags 10 according to the present invention may have a volume of several liters and be usable for storing trash such as yard waste, etc.

The periphery 14 of the bag 10 defines the opening 12 which represents the cross section of the bag 10. While bags 10 having a constant cross section are illustrated, it is to be understood that bags 10 of variable cross section are included within the scope of the present invention. While the illustrated bags 10 have cross sections at any point throughout the depth of the bag 10 which are parallel to the plane defined by the opening 12, it is to be understood that bags 10 having an angled construction with cross sections disposed in acute angular relationship relative to the plane of the opening 12 are encompassed by the present invention as well.

Perpendicular to the plane of the opening 12 is the fill direction 24. The fill direction 24 is generally the direction in which contents are added to and/or removed from the bag 10. Of course, it is to be understood that contents will not necessarily be added to or removed from the bag 10 in a direction exactly coincident and parallel the fill direction 24, but instead the fill direction 24 represents the principal direction of filing or emptying the bag 10. Radially perpendicular to the fill direction 24 when the bag 10 is open is the transverse direction. When the bag 10 is in a flat, closed condition, the transverse direction lies within the plane of the bag 10.

While the figures illustrate a bag 10 having a generally straight periphery 14, it is recognized that bags 10 having sinusoidally-shaped peripheries are known in the art. Sinusoidally-shaped peripheries are used to provide handles for cross-tying the opening 12 of the bag 10 together to provide closure. If a bag 10 having a periphery 14 other than that illustrated by the figures is selected, the fill direction 24 is taken perpendicular to the cross section of the bag 10 which occurs at the point of the periphery 14 closest to the bottom 16 of the bag 10.

As used herein, the closure zone 26 is a region of the bag 10 juxtaposed with the periphery 14. The closure zone 26 is extensible in a direction generally parallel to the fill direction 24. The closure zone 26 comprises a region of the bag 10 which is extensible in response to applied tensile forces, importantly, the closure zone 26 has greater degree of elastic extensibility than regions of the bag 10 not comprising the closure zone 26. Preferably, the closure zone 26 has approximately 10 to 15 centimeters of elastic extensibility for a bag 10 used as a typical trash receptacle in the kitchen. A larger bag 10 will typically require a greater closure zone 26 in order to bridge the opening 12 of the bag 10. The closure zone 26 may be extensible in either of two perpendicular directions lying within the plane of the bag 10, although the primary direction of extensibility is generally parallel the fill direction 24.

Examining the closure zone 26 in more detail, in a preferred embodiment, the closure zone 26 completely circumscribes the opening 12 of the bag 10. However, it is to be recognized that the closure zone 26 need not completely circumscribe the opening 12 of the bag 10. For example, the closure zone 26 may subtend a plurality of opposed sectors of the bag 10. In such an embodiment, preferably the closure zone 26 cumulatively subtends a total of 180°, although a lesser closure zone 26 will suffice for smaller bags 10. Basically, the closure zone 26 need only subtend enough of the circumference to form two, or more if desired, handles for closing the bag 10. This total is preferably equally divided between each of the sectors. In such an embodiment, each sector of the closure zone 26 may function independently of the others and form a handle for localized extension parallel to the fill direction 24 and tying to other sectors of the closure zone 26. Between sectors of the closure zone 26 are portions of the bag 10 which need not be generally extensible in a direction parallel the fill direction 24. Such intermediate portions of the bag 10 may be relatively inextensible or extensible in a circumferential direction generally parallel the periphery 14 of the bag 10.

Preferably, the closure zone 26 is optionally spaced apart from the periphery 14 in the fill direction 24 towards the bottom 16 of the bag 10. This spacing provides a peripheral zone 28 adjacent the periphery 14 of the bag 10. The peripheral zone 28 is disposed between the periphery 14 of the bag 10 and the closure zone 26. The peripheral zone 28 has less extensibility in the fill direction 24 than the closure zone 26. Preferably, the peripheral zone 28 circumscribes the periphery 14 of the bag 10. However, as noted above with respect to the various constructions which are available, if the closure zone 26 comprises two or more sectors of the bag 10, the peripheral zone 28 may be disposed between the edge of such sectors comprising the closure zone 26 and the periphery 14.

The purpose of the peripheral zone 28 is to prevent undue weakness from occurring at the periphery 14 of the bag 10. This arrangement is believed to reduce occurrences of unintended tearing of the bag 10 caused by rips emanating at the periphery 14. The peripheral zone 28 has a width, taken parallel to the fill direction 24, of from 0.1 to 100 centimeters. The peripheral zone has a width preferably at least 0.3, more preferably at least 0.6, and most preferably at least 0.95 centimeters, and preferably less than 10, more preferably less than 2.5, and most preferably less than 1.9 centimeters. If the periphery 14 of the bag 10 is sinusoidal, or of another irregular shape, preferably the peripheral zone 28 is generally parallel to the periphery 14.

Figure 2:
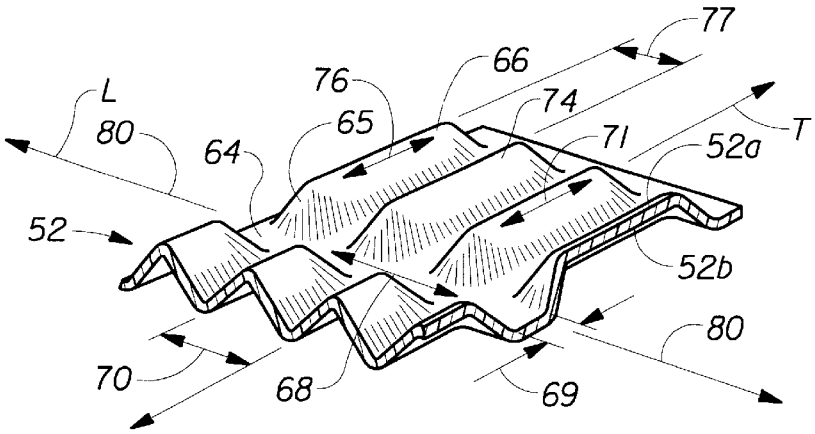
FIG. 2 is a fragmentary illustration of one polymeric film material of the flexible bag in a substantially untensioned condition.
Figure 3:
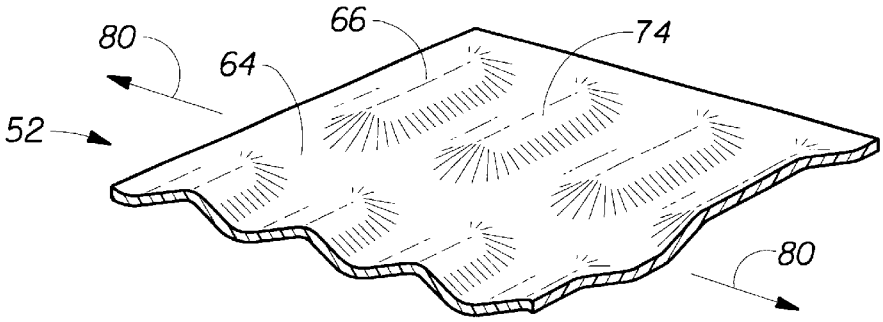
FIG. 3 is a fragmentary illustration of the polymeric film of FIG. 2 in a partially tensioned condition.
Figure 4:
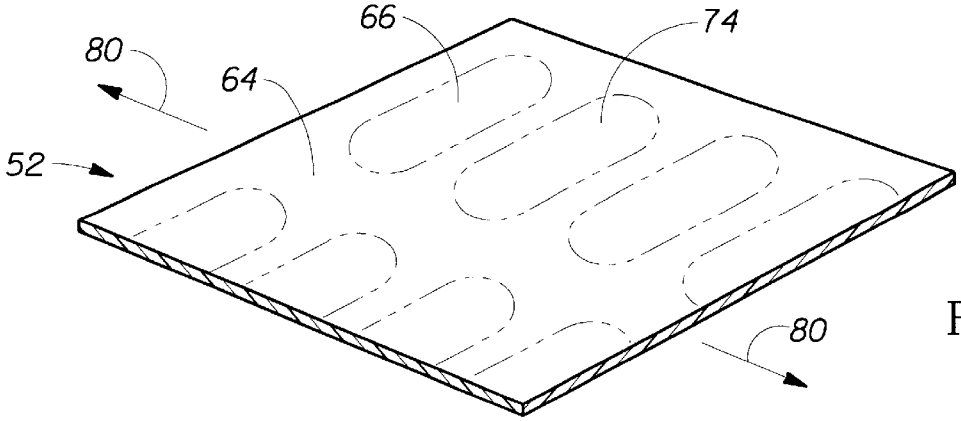
FIG. 4 is a fragmentary perspective view of FIG. 2 in a yet more tensioned condition.

Referring to FIGS. 2–4, materials such as those illustrated and described herein as suitable for use in accordance with the present invention, as well as methods for making and characterizing the same are described in commonly assigned U.S. Pat. No. 5,518,801, iss. May 21, 1996 to Chappell et al., incorporated herein by reference. Such materials are suitable for the closure zone 26, as well as potentially suitable for the body of the bag 10 according to the present invention. Particularly suitable materials include linear low density polyethylene having a thickness of 0.003±0.001 centimeters available from the Heritage Bag Company of Atlanta, Ga. or from the Clorox Company of San Francisco, Calif. may be utilized.

Referring now to FIGS. 2–4, sheet material 52 includes a "strainable network" of distinct regions. As used herein, the term "strainable network" refers to an interconnected and interrelated group of regions which are able to be extended to some useful degree in a predetermined direction providing the sheet material 52 with an elastic-like behavior in response to an applied and subsequently released elongation. The strainable network includes at least a first region 64 and a second region 66. Sheet material 52 includes a transitional region 65 which is at the interface between the first region 64 and the second region 66. The transitional region 65 will exhibit complex combinations of the behavior of both the first region 64 and the second region 66. It is recognized that every embodiment of such sheet materials 52 suitable for use in accordance with the present invention will have a transitional region; however, such materials are defined by the behavior of the sheet material 52 in the first region 64 and the second region 66. Therefore, the ensuing description will be concerned with the behavior of the sheet material 52 in the first regions 64 and the second regions 66 only since it is not dependent upon the complex behavior of the sheet material 52 in the transitional regions 65.

Sheet material 52 has a first surface 52*a* and an opposing second surface 52*b*. In the preferred embodiment shown in FIG. 2, the strainable network includes a plurality of first regions 64 and a plurality of second regions 66. The first regions 64 have a first axis 68 and a second axis 69, wherein the first axis 68 is preferably longer than the 30 second axis 69. The first axis 68 of the first region 64 is substantially parallel to the longitudinal axis "L" of the sheet material 52 while the second axis 69 is substantially parallel to the transverse axis "T" of the sheet material 52. Preferably, the second axis of the first region 64, the width of the first region 64, is from about 0.01 inches to about 0.5 inches, and more preferably from about 0.03 inches to about 0.25 inches. The second regions 66 have a first axis 70 and a second axis 71. The first axis 70 is substantially parallel to the longitudinal axis of the sheet material 52, while the second axis 71 is substantially parallel to the transverse axis of the sheet material 52. Preferably, the second axis of the second region 66, the width of the second region 66, is from about 0.01 inches to about 2.0 inches, and more preferably from about 0.125 inches to about 1.0 inches. In the preferred embodiment of FIG. 2, the first regions 64 and the second regions 66 are substantially linear, extending continuously in a direction substantially parallel to the longitudinal axis of the sheet material 52.

The first region 64 has an elastic modulus E1 and a cross-sectional area A1. The second region 66 has a modulus E2 and a cross-sectional area A2.

In the illustrated embodiment, the sheet material 52 has been "formed" such that the sheet material 52 exhibits a resistive force along an axis, which in the case of the illustrated embodiment is substantially parallel to the longitudinal axis of the web, when subjected to an applied axial elongation in a direction substantially parallel to the longitudinal axis. As used herein, the term "formed" refers to the creation of a desired structure or geometry upon a sheet material 52 that will substantially retain the desired structure or geometry when it is not subjected to any externally applied elongations or forces. A sheet material 52 of the present invention is comprised of at least a first region 64 and a second region 66, wherein the first region 64 is visually distinct from the second region 66. As used herein, the term "visually distinct" refers to features of the sheet material 52 which are readily discernible to the normal naked eye when the sheet material 52 or objects embodying the sheet material 52 are subjected to normal use. As used herein the term "surface-pathlength" refers to a measurement along the topographic surface of the region in question in a direction substantially parallel to an axis. The method for determining the surface-pathlength of the respective regions can be found in the Test Methods section of the above-referenced and above-incorporated Chappell et al. patent.

Methods for forming such sheet materials 52 useful in the present invention include, but are not limited to, embossing by mating plates or rolls, thermoforming, high pressure hydraulic forming, or casting. While the entire portion of the web 52 has been subjected to a forming operation, the present invention may also be practiced by subjecting to formation only a portion thereof, e.g., a portion of the material comprising the bag body 10, as will be described in detail below.

In the preferred embodiment shown, the first regions 64 are substantially planar. That is, the material within the first region 64 is in substantially the same condition before and after the formation step undergone by web 52. The second regions 66 include a plurality of raised rib-like elements 74. The rib-like elements 74 may be embossed, debossed or a combination thereof. The rib-like elements 74 have a first or major axis 76 which is substantially parallel to the transverse axis of the web 52 and a second or minor axis 77 which is substantially parallel to the longitudinal axis of the web 52. The length parallel to the first axis 76 of the rib-like elements 74 is at least equal to, and preferably longer than the length parallel to the second axis 77. Preferably, the ratio of the first axis 76 to the second axis 77 is at least about 1:1 or greater, and more preferably at least about 2:1 or greater.

The rib-like elements 74 in the second region 66 may be separated from one another by unformed areas. Preferably, the rib-like elements 74 are adjacent one another and are separated by an unformed area of less than 0.10 inches as measured perpendicular to the major axis 76 of the rib-like elements 74, and more preferably, the rib-like elements 74 are contiguous having essentially no unformed areas between them.

The first region 64 and the second region 66 each have a "projected pathlength". As used herein the term "projected pathlength" refers to the length of a shadow of a region that would be thrown by parallel light. The projected pathlength of the first region 64 and the projected pathlength of the second region 66 are equal to one another.

The first region 64 has a surface-pathlength, L1, less than the surface-pathlength, L2, of the second region 66 as measured topographically in a direction parallel to the longitudinal axis of the web 52 while the web is in an untensioned condition. Preferably, the surface-pathlength of the second region 66 is at least about 15% greater than that of the first region 64, more preferably at least about 30% greater than that of the first region 64, and most preferably at least about 70% greater than that of the first region 64. In general, the greater the surface-pathlength of the second region 66, the greater will be the elongation of the web before encountering the force wall. Suitable techniques for measuring the surface-pathlength of such materials are described in the above-referenced and above-incorporated Chappell et al. patent.

Sheet material 52 exhibits a modified "Poisson lateral contraction effect". substantially less than that of an otherwise identical base web of similar material composition. The method for determining the Poisson lateral contraction effect of a material can be found in the Test Methods section of the above-referenced and above-incorporated Chappell et al. patent. Preferably, the Poisson lateral contraction effect of webs suitable for use in the present invention is less than about 0.4 when the web is subjected to about 20% elongation. Preferably, the webs exhibit a Poisson lateral contraction effect less than about 0.4 when the web is subjected to about 40, 50 or even 60% elongation. More preferably, the Poisson lateral contraction effect is less than about 0.3 when the web is subjected to 20, 40, 50 or 60% elongation. The Poisson lateral contraction effect of such webs is determined by the amount of the web material which is occupied by the first and second regions 66, respectively. As the area of the sheet material 52 occupied by the first region 64 increases the Poisson lateral contraction effect also increases. Conversely, as the area of the sheet material 52 occupied by the second region 66 increases the Poisson lateral contraction effect decreases. Preferably, the percent area of the sheet material 52 occupied by the first area is from about 2% to about 90%, and more preferably from about 5% to about 50%.

Sheet materials 52 of the prior art which have at least one layer of an elastomeric material will generally have a large Poisson lateral contraction effect, i.e., they will "neck down" as they elongate in response to an applied force. Web materials useful in accordance with the present invention can be designed to moderate if not substantially eliminate the Poisson lateral contraction effect.

For sheet material 52, the direction of applied axial elongation, D, indicated by arrows 80, is substantially perpendicular to the first axis 76 of the rib-like elements 74. The rib-like elements 74 are able to unbend or geometrically deform in a direction substantially perpendicular to their first axis 76 to allow extension in web 52.

As the web of sheet material 52 is subjected to an applied axial elongation, D, indicated by arrows 80, the first region 64 having the shorter surface-pathlength, L1, provides most of the initial resistive force, P1, as a result of molecular-level deformation, to the applied elongation. In this stage, the rib-like elements 74 in the second region 66 are experiencing geometric deformation, or unbending and offer minimal resistance to the applied elongation. In transition to the next stage, the rib-like elements 74 are becoming aligned with (i.e., coplanar with) the applied elongation. That is, the second region 66 is exhibiting a change from geometric deformation to molecular-level deformation. This is the onset of the force wall. In the stage seen in FIG. 4, the rib-like elements 74 in the second region 66 have become substantially is aligned with (i.e., coplanar with) the plane of applied elongation (i.e. the second region 66 has reached its limit of geometric deformation) and begin to resist further elongation via molecular-level deformation. The second region 66 now contributes, as a result of molecular-level deformation, a second resistive force, P2, to further applied elongation. The resistive forces to elongation provided by both the molecular-level deformation of the first region 64 and the molecular-level deformation of the second region 66 provide a total resistive force, PT, which is greater than the resistive force which is provided by the molecular-level deformation of the first region 64 and the geometric deformation of the second region 66.

The resistive force P1 is substantially greater than the resistive force P2 when (L1+D) is less than L2. When (L1+D) is less than L2 the first region 64 provides the initial resistive force P1, generally satisfying the equation:

$$P1 = \frac{(A1 \times E1 \times D)}{L1}$$

When (L1+D) is greater than L2 the first and second regions 66 provide a combined total resistive force PT to the applied elongation, D, generally satisfying the equation:

$$PT = \frac{(A1 \times E1 \times D)}{L1} + \frac{(A2 \times E2 \times |L1 + D - L2|)}{L2}$$

The maximum elongation occurring while in the stage corresponding to FIGS. 2–3, before reaching the stage depicted in FIG. 4, is the "available stretch" of the formed web material. The available stretch corresponds to the distance over which the second region 66 experiences geometric deformation. The range of available stretch can be varied from about 10% to 100% or more, and can be largely controlled by the extent to which the surface-pathlength L2 in the second region 66 exceeds the surface-pathlength L1 in the first region 64 and the composition of the base film. The term available stretch is not intended to imply a limit to the elongation which the web of the present invention may be subjected to as there are applications where elongation beyond the available stretch is desirable.

When the sheet material 52 is subjected to an applied elongation, the sheet material 52 exhibits an elastic-like behavior as it extends in the direction of applied elongation and returns to its substantially untensioned condition once the applied elongation is removed, unless the sheet material 52 is extended beyond the point of yielding. The sheet material 52 is able to undergo multiple cycles of applied elongation without losing its ability to substantially recover. Accordingly, the web is able to return to its substantially untensioned condition once the applied elongation is removed.

While the sheet material 52 may be easily and reversibly extended in the direction of applied axial elongation, in a direction substantially perpendicular to the first axis of the rib-like elements 74, the web material is not as easily extended in a direction substantially parallel to the first axis of the rib-like elements 74. The formation of the rib-like elements 74 allows the rib-like elements 74 to geometrically deform in a direction substantially perpendicular to the first or major axis of the rib-like elements 74, while requiring substantially molecular-level deformation to extend in a direction substantially parallel to the first axis of the rib-like elements 74.

The amount of applied force required to extend the web is dependent upon the composition and cross-sectional area of the sheet material 52 and the width and spacing of the first regions 64, with narrower and more widely spaced first regions 64 requiring lower applied extensional forces to achieve the desired elongation for a given composition and cross-sectional area. The first axis, (i.e., the length) of the first regions 64 is preferably greater than the second axis, (i.e., the width) of the first regions 64 with a preferred length to width ratio of from about 5:1 or greater.

The depth and frequency of rib-like elements 74 can also be varied to control the available stretch of a web of sheet material 52 suitable for use in accordance with the present invention. The available stretch is increased if for a given frequency of rib-like elements 74, the height or degree of formation imparted on the rib-like elements 74 is increased. Similarly, the available stretch is increased if for a given height or degree of formation, the frequency of the rib-like elements 74 is increased.

There are several functional properties that can be controlled through the application of such materials to flexible bags 10 of the present invention. The functional properties are the resistive force exerted by the sheet material 52 against an applied elongation and the available stretch of the sheet material 52 before the force wall is encountered. The resistive force that is exerted by the sheet material 52 against an applied elongation is a function of the material (e.g., composition, molecular structure and orientation, etc.) and cross-sectional area and the percent of the projected surface area of the sheet material 52 that is occupied by the first region 64. The higher the percent area coverage of the sheet material 52 by the first region 64, the higher the resistive force that the web will exert against an applied elongation for a given material composition and cross-sectional area. The percent coverage of the sheet material 52 by the first region 64 is determined in part, if not wholly, by the widths of the first regions 64 and the spacing between adjacent first regions 64.

The available stretch of the web material is determined by the surface-pathlength of the second region 66. The surface-pathlength of the second region 66 is determined at least in part by the rib-like element 74 spacing, rib-like element 74 frequency and depth of formation of the rib-like elements 74 as measured perpendicular to the plane of the web material. In general, the greater the surface-pathlength of the second region 66 the greater the available stretch of the web material.

As discussed above with regard to FIGS. 2–4, the sheet material 52 initially exhibits a certain resistance to elongation provided by the first region 64 while the rib-like elements 74 of the second region 66 undergo geometric motion. As the rib-like elements 74 transition into the plane of the first regions 64 of the material, an increased resistance to elongation is exhibited as the entire sheet material 52 then undergoes molecular-level deformation. Accordingly, sheet materials 52 of the type depicted in FIGS. 2–4 and described in the above-referenced and above-incorporated Chappell et al. patent provide the performance advantages of the present invention when formed into closed containers such as the flexible bags 10 of the present invention.

Sheet materials 52 useful in accordance with the present invention such as those depicted in FIGS. 2–4 exhibit a three-dimensional cross-sectional profile wherein the sheet material 52 is (in an un-tensioned condition) deformed out of the predominant plane of the sheet material 52. This provides additional surface area for gripping and dissipates the glare normally associated with substantially planar, smooth surfaces. The three-dimensional rib-like elements 74 also provide a "cushiony" tactile impression when the bag 10 is gripped in one's hand, also contributing to a desirable tactile impression versus conventional bag 10 materials and providing an enhanced perception of thickness and durability. The additional texture also reduces noise associated with certain types of film materials, leading to an enhanced aural impression.

Suitable mechanical methods of forming the base material into a web of sheet material 52 suitable for use in the present invention are well known in the art and are disclosed in the aforementioned Chappell et al. patent and commonly-assigned U.S. Pat. No. 5,650,214, issued Jul. 22, 1997 in the names of Anderson et al., the disclosures of which are hereby incorporated herein by reference.

Figure 5:
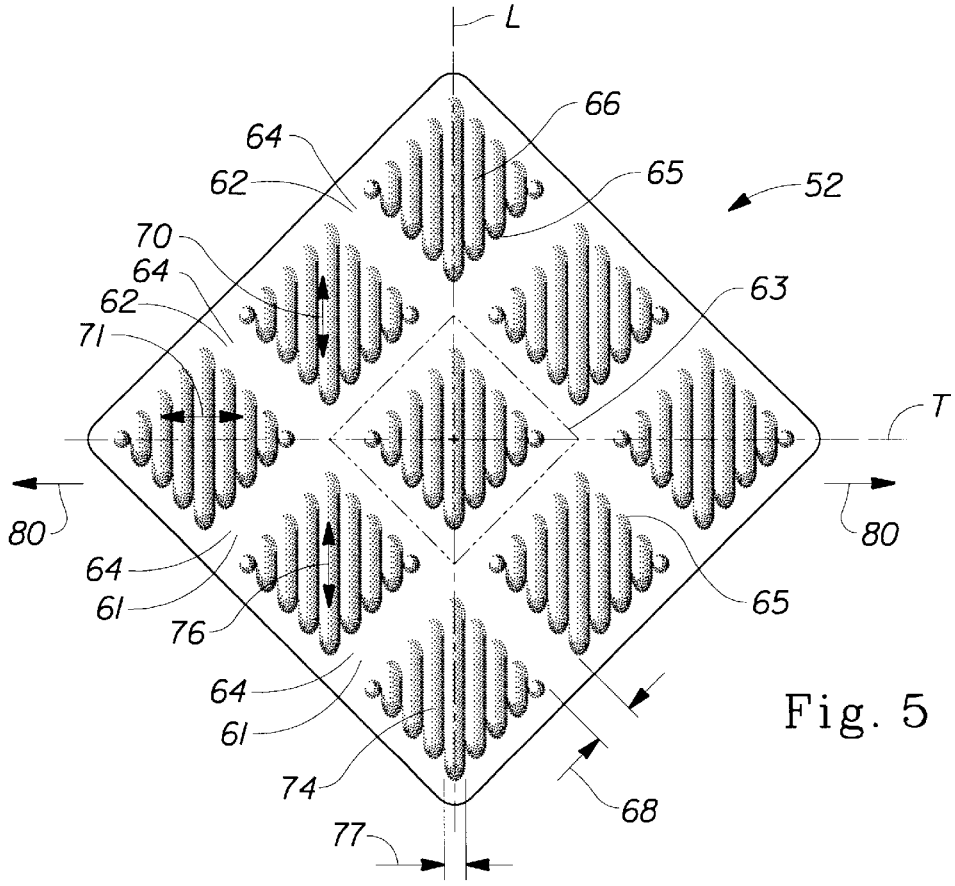
FIG. 5 is a fragmentary top plan view of another embodiment of sheet material usable in the present invention.
Figure 6:
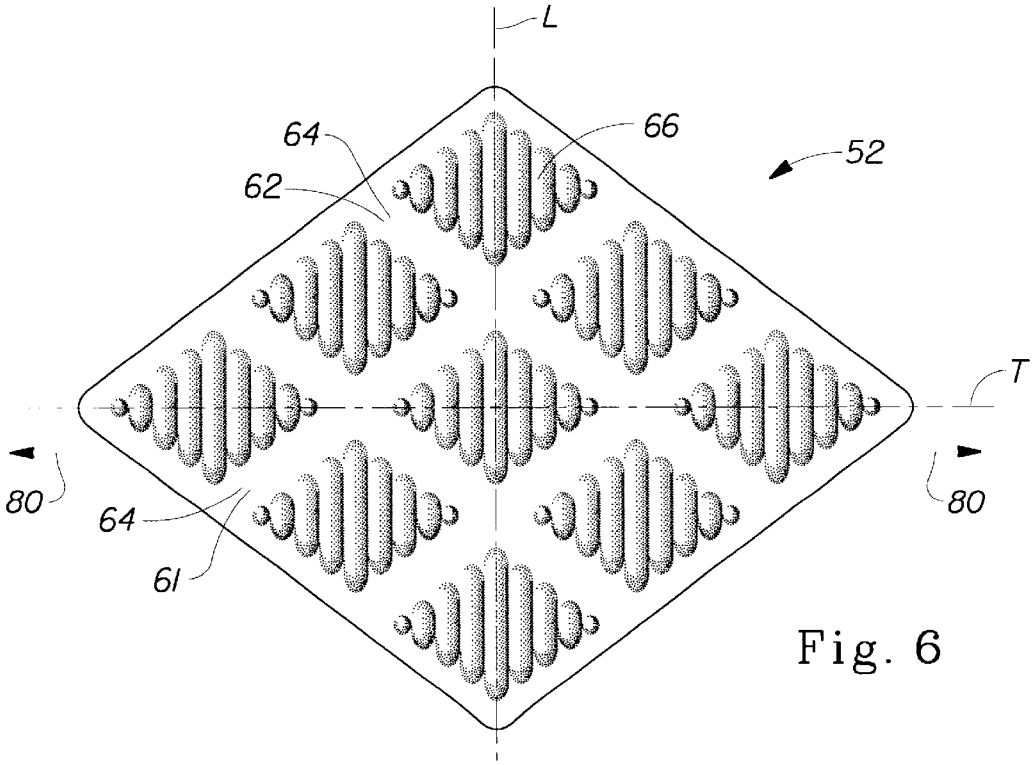
FIG. 6 is a fragmentary top plan view of the sheet material in FIG. 5 in a partially tensioned condition.

Referring now to FIG. 5, other patterns for first and second regions 66 may also be employed as sheet materials 52 suitable for use in accordance with the present invention. The sheet material 52 is shown in FIG. 5 in its substantially untensioned condition. The sheet material 52 has two centerlines, a longitudinal centerline, which is also referred to hereinafter as an axis, line, or direction "L" and a transverse or lateral centerline, which is also referred to hereinafter as an axis, line, or direction "T". The transverse centerline "T" is generally perpendicular to the longitudinal centerline "L". Materials of the type depicted in FIGS. 5–6 are described in greater detail in the aforementioned Anderson et al. patent.

As discussed above with regard to FIG. 24, sheet material 52 includes a "strainable network" of distinct regions. The strainable network includes a plurality of first regions 64 and a plurality of second regions 66 which are visually distinct from one another. Sheet material 52 also includes transitional regions 65 which are located at the interface between the first regions 64 and the second regions 66. The transitional regions 65 will exhibit complex combinations of the behavior of both the first region 64 and the second region 66, as discussed above.

Sheet material 52 has a first surface, (facing the viewer in FIGS. 5–6), and an opposing second surface (not shown). In the preferred embodiment shown in FIGS. 5–6, the strainable network includes a plurality of first regions 64 and a plurality of second regions 66. A portion of the first regions 64, indicated generally as 61, are substantially linear and extend in a first direction. The remaining first regions 64, indicated generally as 62, are substantially linear and extend in a second direction which is substantially perpendicular to the first direction. While it is preferred that the first direction be perpendicular to the second direction, other angular relationships between the first direction and the second direction may be suitable so long as the first regions 61 and 62 intersect one another. Preferably, the angles between the first and second directions ranges from about 45° to about 135°, with 90° being the most preferred. The intersection of the first regions 61 and 62 forms a boundary, indicated by phantom line 63 in FIG. 5, which completely surrounds the second regions 66.

Preferably, the width 68 of the first regions 64 is from about 0.01 inches to about 0.5 inches, and more preferably from about 0.03 inches to about 0.25 inches. However, other width dimensions for the first regions 64 may be suitable. Because the first regions 61 and 62 are perpendicular to one another and equally spaced apart, the second regions 66 have a square shape. However, other shapes for the second region 66 are suitable and may be achieved by changing the spacing between the first regions 64 and/or the alignment of the first regions 61 and 62 with respect to one another. The second regions 66 have a first axis 70 and a second axis 71. The first axis 70 is substantially parallel to the longitudinal axis of the web material 52, while the second axis 71 is substantially parallel to the transverse axis of the web material 52. The first regions 64 have an elastic modulus E1 and a cross-sectional area A1. The second regions 66 have an elastic modulus E2 and a cross-sectional area A2.

In the embodiment shown in FIGS. 2–6, the first regions 64 are substantially planar. That is, the material within the first regions 64 is in substantially the same condition before and after the formation step undergone by web 52. The second regions 66 include a plurality of raised rib-like elements 74. The rib-like elements 74 may be embossed, debossed or a combination thereof. The rib-like elements 74 have a first or major axis 76 which is substantially parallel to the longitudinal axis of the web 52 and a second or minor axis 77 which is substantially parallel to the transverse axis of the web 52.

The rib-like elements 74 in the second region 66 may be separated from one another by unformed areas, essentially unembossed or debossed, or simply formed as spacing areas. Preferably, the rib-like elements 74 are adjacent one another and are separated by an unformed area of less than 0.10 inches as measured perpendicular to the major axis 76 of the rib-like elements 74, and more preferably, the rib-like elements 74 are contiguous having essentially no unformed areas between them.

The first regions 64 and the second regions 66 each have a "projected pathlength". As used herein the term "projected pathlength" refers to the length of a shadow of a region that would be thrown by parallel light. The projected pathlength of the first region 64 and the projected pathlength of the second region 66 are equal to one another.

The first region 64 has a surface-pathlength, L1, less than the, surface-pathlength, L2, of the second region 66 as measured topographically in a parallel direction while the web is in an untensioned condition. Preferably, the surface-pathlength of the second region 66 is at least about 15% greater than that of the first region 64, more preferably at least about 30% greater than that of the first region 64, and most preferably at least about 70% greater than that of the first region 64. In general, the greater the surface-pathlength of the second region 66, the greater will be the elongation of the web before encountering the force wall.

For sheet material 52, the direction of applied axial elongation, D, indicated by arrows 80 in FIGS. 5–6, is substantially perpendicular to the first axis 76 of the rib-like elements 74. This is due to the fact that the rib-like elements 74 are able to unbend or geometrically deform in a direction substantially perpendicular to their first axis 76 to allow extension in web 52.

Referring now to FIG. 6, as web 52 is subjected to an applied axial elongation, D, indicated by arrows 80 in FIGS. 5–6, the first regions 64 having the shorter surface-pathlength, L1, provide most of the initial resistive force, P1, as a result of molecular-level deformation, to the applied elongation which corresponds to stage I. While in stage I, the rib-like elements 74 in the second regions 66 are experiencing geometric deformation, or unbending and offer minimal resistance to the applied elongation. In addition, the shape of the second regions 66 changes as a result of the movement of the reticulated structure formed by the intersecting first regions 61 and 62. Accordingly, as the web 52 is subjected to the applied elongation, the first regions 61 and 62 experience geometric deformation or bending, thereby changing the shape of the second regions 66. The second regions 66 are extended or lengthened in a direction parallel to the direction of applied elongation, and collapse or shrink in a direction perpendicular to the direction of applied elongation.

Various compositions suitable for constructing the flexible bags 10 of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials.

Once the desired sheet materials 52 are manufactured in any desirable and suitable manner, comprising all or part of the materials to be utilized for the bag 10 body, the bag 10 may be constructed in any known and suitable fashion such as those known in the art for making such bags 10 in commercially available form. Heat, mechanical, or adhesive sealing technologies may be utilized to join various components or elements of the bag 10 to themselves or to each other. In addition, the bag 10 bodies may be thermoformed, blown, or otherwise molded rather than reliance upon folding and bonding techniques to construct the bag 10 bodies from a web or sheet of material. Two recent U.S. Patents which are Mustrative of the state of the art with regard to flexible storage bags 10 similar in overall structure to those depicted in the figures but of the types currently available are U.S. Pat. No. 5,554,093, issued Sep. 10, 1996 to Porchia et al., and U.S. Pat. No. 5,575,747, issued Nov. 19, 1996 to Dais et al.

One benefit to having a closure zone 26 made of the aforementioned material having two distinct regions is that the ribs of the second region 66 provide an increased tactile sensation and gripping surface for tying together opposed sides of the closure zone 26. This reduces the likelihood of dropping or mishandling the bag 10, particularly when the contents are bulky or heavy. It will be apparent to one of skill that the orientation of the rib-like elements 74 will be generally perpendicular to the fill direction 24 for the embodiments described above. This arrangement allows for not only good texture of the closure zone 26, but also extension of the closure zone 26 parallel to the fill direction 24.

EXAMPLES

The exemplary bag 10 of FIG. 1 has an overall dimension taken parallel to the fill direction 24 of 84 centimeters, and an overall transverse dimension in the flattened condition of 61 centimeters. The bag 10 may be considered to be divided into four zones, each extending entirely circumferentially around the bag 10. The zones are spaced from one another in the final direction 24. The bag 10 may be made of polyethylene having a thickness of 0.019 centimeters.

The first zone 28 is the peripheral zone 28. The peripheral zone 28 is adjacent the periphery 14 of the bag 10 and has no induced extensibility, beyond that inherent in the parent material. The second zone 26 is the closure zone 26. The closure zone 26 is adjacent the peripheral zone 28 and disposed towards the bottom 16 of the bag 10. The closure zone 26 has induced extensibility oriented in the fill direction 24 as indicated by arrows 80. The third zone 30 is adjacent the second zone 26 and has induced extensibility oriented in the transverse direction as indicated by arrows 80. The fourth zone 32 is adjacent the bottom 16 of the bag 10 and, like the first zone 28, has no induced extensibility. The first and fourth zones 28,32 having no induced extensibility have dimensions taken in the fill direction 24 of 1.3 and 6.4 centimeters, respectively. The second zone 26 has a dimension of 55.9 centimeters and the third zone 30 has a dimension taken in the fill direction 24 of 20.3 centimeters. The extensibility may be approximately 40% of the overall dimension of the bag 10 taken parallel to the fill direction 24, although greater and lesser extensibilities are suitable.

Figure 7:
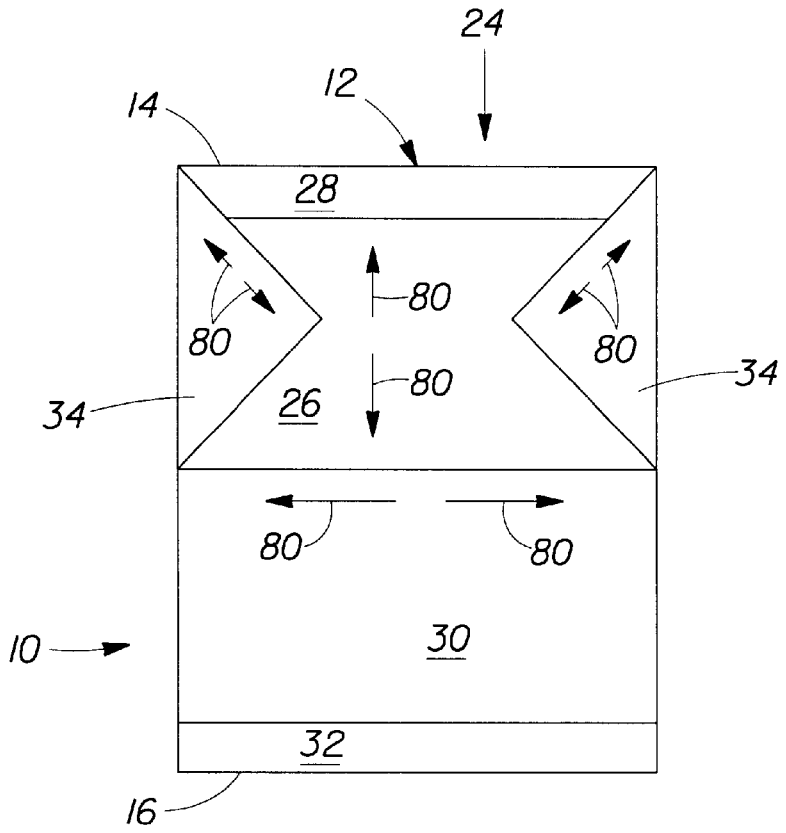
FIG. 7 is an alternative embodiment of the bag of FIG. 1.

Referring to FIG. 7, a second example of a bag 10 representing an alternative embodiment according to the present invention is illustrated. This bag 10 has a volume of 49.2 liters, an overall dimension in the fill direction 24 of 75 centimeters, and a dimension in the transverse direction when flattened of 61 centimeters. The bag 10 has the four zones discussed above. The first zone 28 is the peripheral zone 28. The peripheral zone 28 is adjacent the periphery 14, has a dimension taken in the fill direction 24 of 4.5 centimeters and no induced extensibility. The second zone 26 is the closure zone 26. The closure zone 26 is adjacent the first and disposed towards the bottom 16 of the bag 10. The second zone 26 has induced extensibility in the fill direction 24 as indicated by arrows 80 and a dimension in the fill direction 24 of 32.4 centimeters. The third zone 30 is adjacent the second, has extensibility in the transverse direction as indicated by arrows 80 and a dimension taken in the fill direction 24 of 33.0 centimeters. The fourth zone 32 is adjacent the bottom 16 of the bag 10, has no induced extensibility and a dimension taken in the fill direction 24 of 5.1 centimeters. Superimposed on the first and second zones 28, 26 are fifth zones 34 having extensibility oriented at 45° relative to the fill dimension as indicated by arrows 80. The fifth zones 34 have a dimension taken in the fill direction 24 of 32.4 centimeters. The 45° extensibility provides the benefit of greater strength and eliminating excessive extensibility from occurring in use. Also, this arrangement allows sheet material 52 to be drawn from the center of the bag 10 towards the edges. While the bag 10 of FIG. 7 has fifth zones 34 in angular relationship relative to the fill direction 24 of 45°, in fact, such fifth zones 34 may be provided at angles of 22 to 67° and still provide the aforementioned benefits.

This arrangement maintains the benefits, noted above, of having material with extensibility in the fill direction 24 available to form the handles to close the bag 10.

Figure 8:
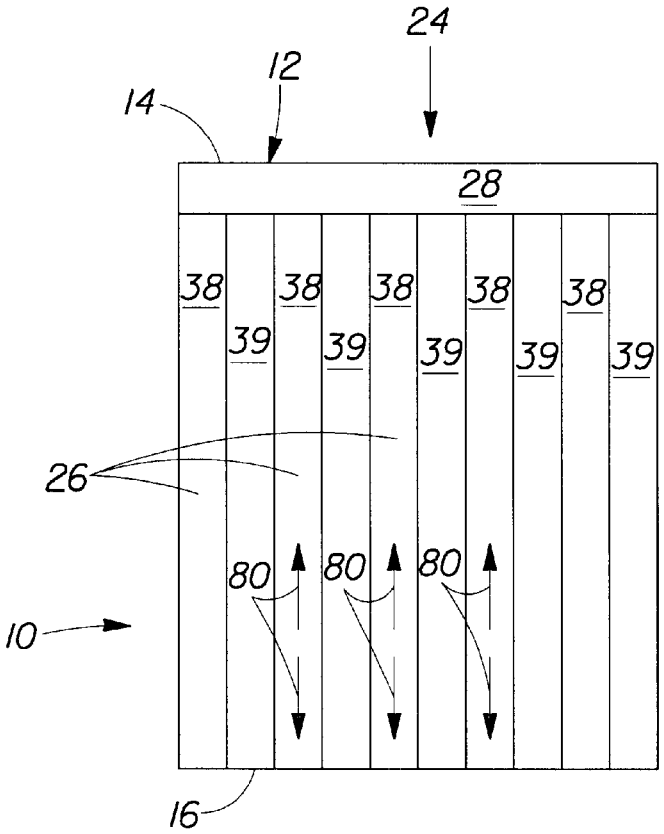
FIG. 8 is an alternative embodiment of the bag of FIG. 1.

Referring to FIG. 8, a third example bag 10 illustrated. This bag 10 has the same overall dimensions, volume and peripheral zone 28 as the bag 10 of FIG. 7. The bag 10 FIG. 8 has alternating regions of induced elasticity 38 and regions with no induced elasticity 39 beyond that present in the parent material. The regions of induced elasticity 38 have extensibility parallel to the fill direction 24 as indicated by arrows 80. These regions of induced elasticity 38 provide the closure system for this bag 10. The alternating regions extend from the periphery 14 to the bottom 16 of the bag 10 and are oriented with a longitudinal axis parallel to the fill direction 24. The regions 38,39 may range in width from 0.6 to 3.0 or more centimeters. The width is taken parallel to the transverse direction. The regions 38,39 may be of equal or unequal width. As shown by the two examples shown above, either or both of the periphery 14 and bottom 16 of this bag 10 may optionally have a continuous circumferential region having no induced elasticity.

What is claimed is:

1. A bag comprising at least one sheet of flexible material assembled to form a semi-enclosed container having an opening defined by a periphery, said bag having a fill direction generally perpendicular to said opening, said bag comprising a closure zone, said closure zone including a first region and a second region, said first region undergoing a substantially molecular-level deformation and said second region initially undergoing a substantially geometric deformation when said sheet is subjected to applied tensile forces, said closure zone of said bag being extensible in said fill direction in response to tensile forces applied generally parallel said fill direction, said closure zone being juxtaposed with said periphery, said bag comprising a third zone with induced extensibility juxtaposed with said closure region and disposed towards said bottom of said bag, said third zone being extensible in a direction perpendicular said fill direction ill response to tensile forces applied in a like direction generally perpendicular to said fill direction.

2. A bag according to claim 1, wherein said third zone does not intercept said bottom of said bag.

3. A bag comprising at least one sheet of flexible material assembled to form a semi-enclosed container having an opening defined by a periphery, said bag having a fill direction generally perpendicular to said opening, said bag comprising a closure zone, said closure zone including a first region and a second region, said first region undergoing a substantially molecular-level deformation and said second region initially undergoing a substantially geometric deformation when said sheet is subjected to applied tensile forces, said closure zone of said bag being extensible in said fill direction in response to tensile forces applied generally parallel said fill direction, said closure zone being spaced apart from said periphery by a peripheral zone adjacent to said periphery and to said closure zone, said peripheral zone having no induced elasticity, said peripheral zone having a width taken parallel to said fill direction, said width being from 0.1 to 100 centimeters, said bag comprising a third zone with induced extensibility juxtaposed with said closure region and disposed towards said bottom of said bag, said third zone being extensible in a direction perpendicular said fill direction in response to tensile forces applied in a like direction generally perpendicular to said fill direction.

4. A bag according to claim 3, wherein said third zone does not intercept said bottom of said bag.

* * * * *

UNITED STATES PATENT AND TRADEMARK OFFICE

CERTIFICATE OF CORRECTION

PATENT NO. : 6,513,975 B1 
DATED : February 4, 2003
INVENTOR(S) : Beverly Ann Julian Jackson et al.

It is certified that error appears in the above-identified patent and that said Letters Patent is hereby corrected as shown below:

Column 3,
Line 24, “filing” should read -- filling --.

Column 5,
Line 11, “the 30 second axis 69” should read -- the second axis 69 --.

Column 7,
Line 28, “substantially is aligned” should read -- substantially aligned --.

Column 11,
Line 54, “Mustrative” should read -- illustrative --.

Column 12,
Line 14, “final” should read -- fill --.

Column 13,
Line 7, “The bag 10FIG. 8” should read -- The bag 10 Fig. 8 --.

Column 14,
Line 5, “ill” should read -- in --.

Signed and Sealed this

Twenty-second Day of April, 2003

JAMES E. ROGAN
*Director of the United States Patent and Trademark Office*